US005590671A

United States Patent [19]

Yachera

[11] Patent Number: 5,590,671

[45] Date of Patent: Jan. 7, 1997

[54] MOBILE BATTERY CLEANING SYSTEM

[75] Inventor: Robert S. Yachera, Mohnton, Pa.

[73] Assignee: East Penn Manufacturing Co., Inc., Lyon Station, Pa.

[21] Appl. No.: 533,520

[22] Filed: Sep. 25, 1995

[51] Int. Cl.[6] ..... B08B 3/10

[52] U.S. Cl. ..... 134/95.1; 134/103.1; 134/103.2; 134/111; 134/104.4

[58] Field of Search ..... 134/95.1, 103.1, 134/103.2, 111, 76, 72, 104.2, 104.4, 201, 123

[56] References Cited

U.S. PATENT DOCUMENTS

| | | | |
|---|---|---|---|
| 766,365 | 8/1904 | Lough | 134/109 |
| 1,774,326 | 8/1930 | Holmes et al. | 15/77 |
| 2,062,193 | 11/1936 | Smith et al. | 134/72 |
| 2,911,457 | 11/1959 | Sabatino et al. . | |
| 3,167,196 | 1/1965 | Eberle | 134/72 |
| 4,325,415 | 4/1982 | Miller, Jr. | 134/152 |
| 4,572,746 | 2/1986 | Wegner . | |
| 4,652,381 | 3/1987 | Inglis . | |
| 5,095,926 | 3/1992 | Wegner | 134/111 |
| 5,265,630 | 11/1993 | Hartmann | 134/111 |

*Primary Examiner*—Frankie L. Stinson
*Attorney, Agent, or Firm*—Zachary T. Wobensmith, III

[57] ABSTRACT

A mobile battery cleaning system to clean industrial batteries on site which can be transported on a truck, which includes a wash cabinet into which the batteries are placed to be high pressure washed by clean water from a holding tank. The washwater is pumped into a reaction tank where it is agitated and chemically treated for sulfates and for ph. A quantity of dry powdered bentonite clay particles with polyelectrolyte and ph adjusters, with a liquid chemical agent is added while the mixture is agitated. Clarification is checked, the contaminants from the batteries are encapsulated and fixed into large "floc" particles which separate from the water. If the system is to be transported to another site, the water may be drained from the reaction tank through cloth filter bags in a collection tank, which extracts the "floc" which is dried and then placed into a drum for storage until the system is returned to its point of origin. The treated water is returned to the holding tank for reuse. If the system is to be returned directly to its point of origin, the "floc" can be removed there and placed in a drum for storage. The drums containing "floc" are disposed of as a regulated residual waste.

4 Claims, 3 Drawing Sheets

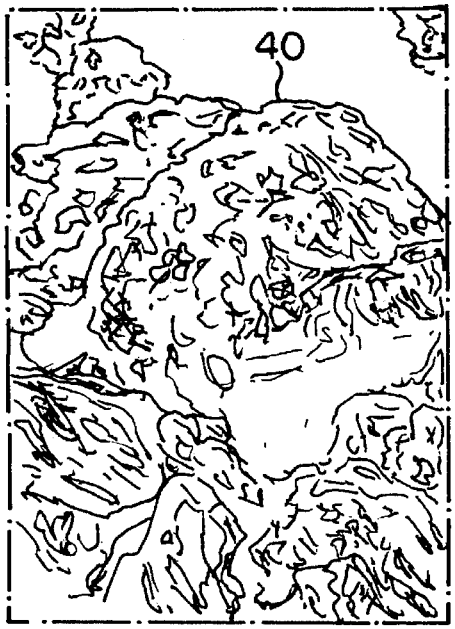
FIG. 3
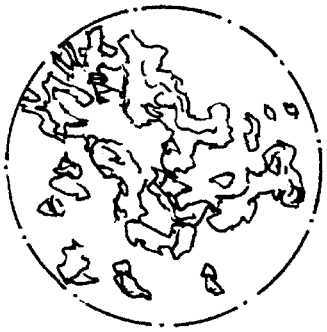
FIG. 4
| (IN ppm) | | | | | |
|---|---|---|---|---|---|
| SAMPLE | LEAD | CADMIUM | SULFATES | IRON | pH |
| 1 | 119 | <0.5 | 2,750 | 785 | 3.7 |
| 2 | 2.64 | 0.09 | 12,500 | 1.5 | 9.2 |
| 3 | 7.91 | 5.30 | 7,000 | 6,024 | 2.4 |
| 4 | >500 | 2.05 | 1,100 | 1,580 | 1.5 |
| 5 | 19.67 | 0.89 | 475 | 341 | 3.8 |
| 6 | <0.5 | <0.5 | 15 | <0.5 | 6.9 |
FIG. 5

MOBILE BATTERY CLEANING SYSTEM

BACKGROUND OF THE INVENTION

1. Field of the Invention

This invention relates to a mobile battery cleaning system of the type that is carried on a truck to a work site, washes batteries on site, treats the waste water on site to form floc which is separated out, transported, stored and disposed of in a storage facility, with the treated water retained for reuse.

2. Description of the Prior Art

Industrial lead acid storage batteries such as those that are used in electric lift trucks, baggage handling trucks and other transporters are subjected to a variety of contaminating conditions that cause corrosion and other problems. The batteries are contaminated from battery charging and discharging as well as from pollutants in the environments where they are in operation. The batteries need to be frequently cleaned to reduce the incidence of corrosion, which causes shorts and grounds to the tray, which results in unsafe operation, expensive downtime and consequent lost production. The contaminants include oil, salts and heavy metals. Various systems have been proposed such as those illustrated in U.S. Pat. Nos. 5,186,758 to Hartman and U.S. Pat. No. 5,265,630 to Hartman. None of the suggested approaches is satisfactory in that the systems do not always use clean water, and may violate governmental regulations which restrict the transport and disposal of hazardous wastes. In some instances the batteries may be taken out of service and returned to the manufacturer for cleaning, which is expensive and increases costs due to downtime.

The washing of batteries to clean them generates contaminants which are carried off in the washwater, such as oil residues, sulfates and heavy metals, which washwater may be dumped into sewage systems which are not equipped to handle the contaminants, or transported to a treatment plant which may or may not be capable of properly treating the materials. The Environmental Protection Agency (E.P.A.) and Department of Transportation (D.O.T.) have very strict regulations for the transport and disposal of hazardous liquid waste, which regulations are difficult and expensive to comply with and are too often ignored.

The system of the invention completely cleans and neutralizes batteries on site with clean water, with the contaminated washwater treated on site by an oil separation/adsorption process in which a powder chemical is added to encapsulate, flocculate and separate out the contaminants. The washwater is filtered to gather the contaminants, and the clean water is returned to a holding tank to be reused to clean batteries at additional sites, with all contaminants removed from the sites, transported to and disposed of in a suitable facility.

SUMMARY OF THE INVENTION

It has now been found that an improved mobile cleaning system for batteries has been found wherein a mobile battery cleaning system is provided that is carried on a truck, brought to the customer's facility and unloaded. The batteries are washed by clean water, the contaminants removed from the batteries by the water are treated with various chemicals to encapsulate and flocculate to form large "floc" particles, which are separated from the water, which is treated and returned to a holding tank for reuse, while the sludge material, which is a non-hazardous solid, is stored and returned to be disposed of at a regulated waste facility.

The principal object of the invention is to provide a mobile battery cleaning system that cleans batteries on site with clean water, encapsulates, flocculates and removes contaminants from the washwater for disposal, and returns the clean washwater for reuse.

A further object of the invention is to provide a mobile battery cleaning system that is safe and economical to use.

A further object of the invention is to provide a mobile battery cleaning system that complies with E.P.A. and D.O.T. requirements.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which:

FIG. 3 is a pictorial, magnified view of an encapsulated oil droplet produced in accordance with the operation of the system of the invention;

FIG. 4 is a view similar to FIG. 3 illustrating the flocculation process in accordance with the operation of the system of the invention; and FIG. 5 is a table of the results of the analysis of six samples of washwater obtained from washing batteries.

It should, of course, be understood that the description and drawings herein are merely illustrative, and that various modifications and changes can be made in the structure disclosed without departing from the spirit of the invention.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Figure 1:
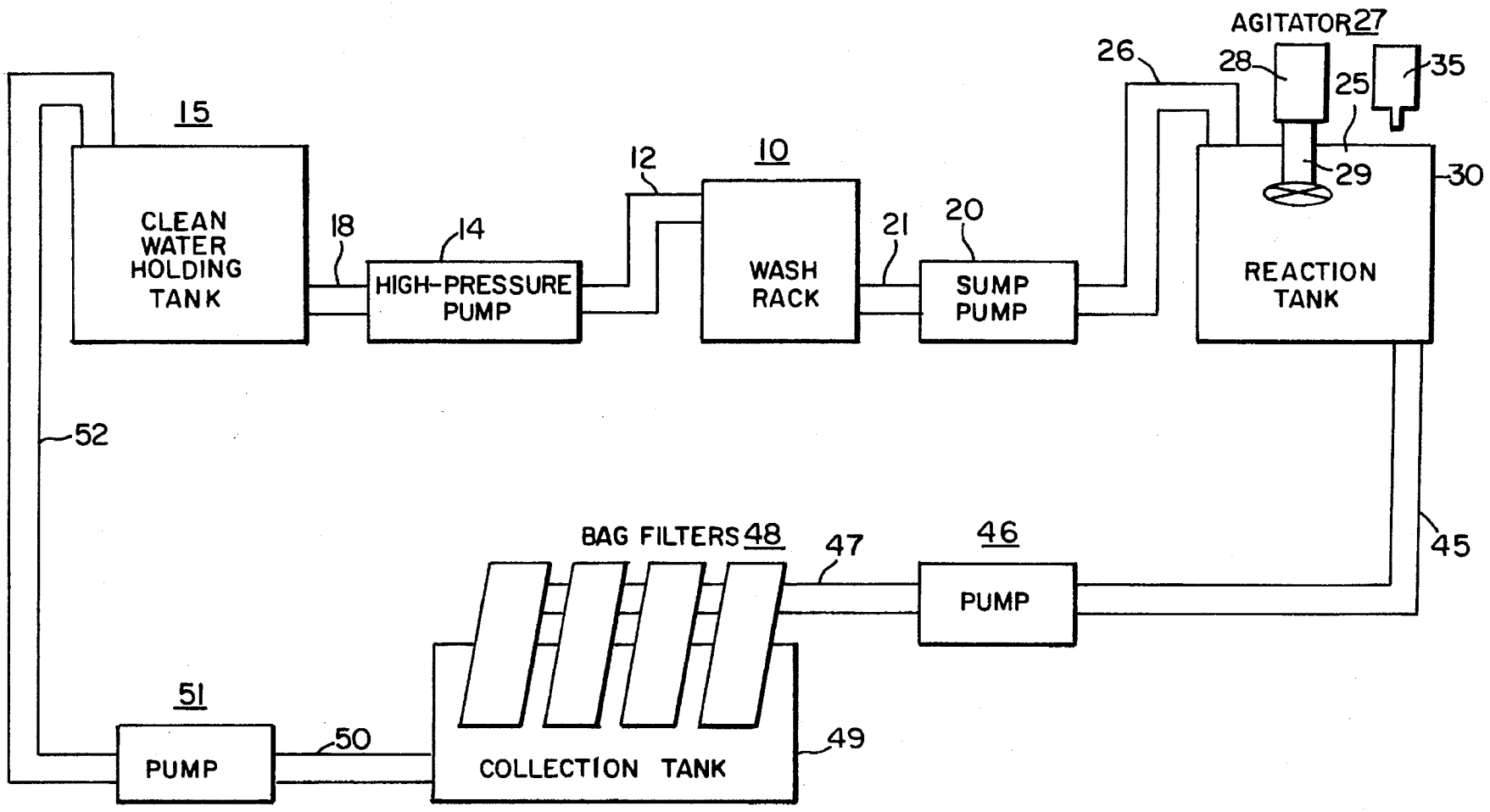
FIG. 1 is a diagrammatic view of the mobile battery cleaning system of the invention.
Figure 2:
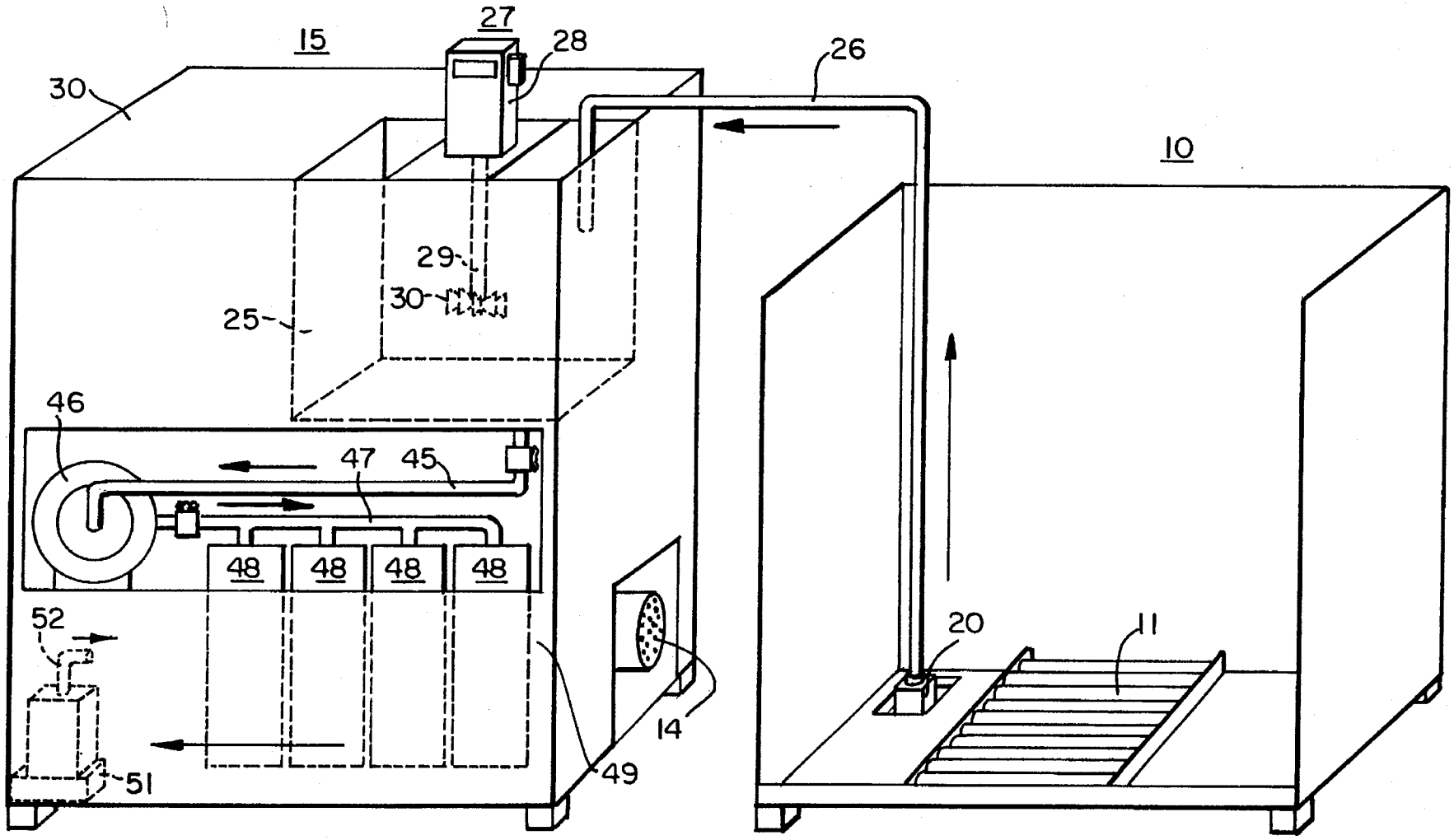
FIG. 2 is a front elevational view of the system of the invention in assembled form.

Referring now more particularly to FIGS. 1 and 2 of the drawings, the mobile battery cleaning system includes a wash cabinet 10, which is preferably constructed of stainless steel and which has a rack 11 to receive batteries (not shown) to be cleaned. Adjacent the wash cabinet 10 a wand (not shown) is connected by pipe 12 to a high pressure pump 14, which is connected by pipe 18 to a supply of clean water in holding tank 15, which tank is preferably of 300 gallon capacity. The pump 14 provides water at the wand (not shown) at a preferred pressure of 1,000 p.s.i., at a volume of 1.6 gallons per minute. The water from the wand (not shown) is directed onto the batteries (not shown) in the wash cabinet 10, flows over them, collects contaminants, and flows down to a sump (not shown) which is connected to a sump pump 20 by pipe 21.

The sump pump 20 is connected to a reaction tank 25 by pipe 26, and pumps contaminated washwater into tank 25.

The tank 25 is provided with an agitator 27, which includes a motor 28 connected to a shaft 29, which extends down into the tank, and has a plurality of blades 30 attached thereto (four being shown), which upon rotation of shaft 29 agitates the washwater in tank 25. As shown in FIG. 2 a cabinet 30 is provided, which contains all the components of the system except wash cabinet 10. The cabinets 10 and 30 are readily transported on a truck to a customer's site where they are unloaded and connected for use.

Referring additionally to FIG. 5 a table is provided which illustrates the results of an analysis of six samples of washwater collected from wash cabinet 10 prior to treatment. The samples are quite varied as to the amounts of contaminants which, for lead for example, runs from less than 0.5 to 500 ppm which would justify treating the washwater as a hazardous waste.

A supply of a dry powder 35 is provided, which is intended to be added to the washwater in tank 25, to be described. The powder 35 is preferably CETCO RM10K powder which is a dry powder blend of Bentonite clay particles, polyelectrolyte and ph adjusters which are designed to remove emulsified oils and metals from water. The RM10K powder is available from CETCO, 1500 West Shore Drive, Arlington Heights, Ill. 60004-1434.

The RM10K powder causes the contaminants in the wash water to be scavenged and fixated into large "floc" particles through a process of flocculation and encapsulation.

Referring additionally to FIGS. 3 and 4 an oil droplet 40 which has been encapsulated by the RM10K powder is therein illustrated at a 3,000× magnification.

In FIG. 4 "floc" particles produced as described above are shown suspended in washwater prior to removal.

The tank 25, which is preferably of 50 gallon capacity, has a pipe 45 connected thereto, and to a pump 46 to remove wash water from tank 25 and pump it through pipe 47 to and through filter bags 48 in collection tank 49. The filter bags 48 separate out the floc particles so that the water is clean, and is pumped out of tank 49 into pipe 50 by pump 51, which is connected to the clean water tank 15 by pipe 52, to return clean water thereto for reuse. The filter bags 48 are preferably formed of cloth, and are intended to extract all the "floc" as the water passes into tank 49.

The mode of operation will now be pointed out.

The system is transported on a truck to the customer's site where batteries are to be cleaned, and is set up as shown in FIGS. 1 and 2. Batteries (not shown) are placed in the wash cabinet 10 and washed with clean water under pressure from tank 15. The washwater with contaminants, such as found in the samples of FIG. 5, is pumped by the sump pump 20 to the reaction tank 25. At the end of the day or when tank 25 is full, the washwater in tank 25 is agitated by agitator 27, and a sample collected which is analyzed to determine the sulfate level. If the sulfate level exceeds 8,000 ppm, barium hydroxide in crystal form is added to a small amount of heated water (150° F.) until it is dissolved. This solution is then added to the washwater to reduce the sulfates. A ph reading is then taken, and a ph neutralizer (such as a soda ash) is added until the ph of the water in tank 25 is between 8.5 and 9.5.

A quantity of RM10K powder and a liquid chemical enhancing agent (such as "Aqua Floc" also available from CETCO) are added in a volume dependant on the quantity of wash water in tank 25, while the water is agitated. The RM10K powder and liquid "Aqua Floc" scavenge and fixate the contaminants in the wash water into large "floc" particles as seen in FIG. 4. A sample is taken to determine the degree of water clarification, and when the desired degree of clarification is reached, the agitation is stopped. The "floc" particles separate from the water, which takes approximately three minutes for a full tank of 50 gallons. The water is drained from tank 25 through the filter bags 48 which extract all the "floc" from the water which passes into collection tank 49, from which it is pumped into clean water holding tank 15 for reuse. The "floc" on the bag filters 48 is allowed to dry, is removed from tank 25 and placed into a drum (not shown) for storage. The "floc" which has been tested and determined to be non-hazardous, is classified as residual waste, and is returned to the facility from which the system originated and disposed of in a regulated landfill. While the "floc" material can be removed from the washwater after cleaning one or more batteries, if the system is to be returned to its origin, the "floc" material in the bag filters 48 can remain in the tank 25 until the system is at its origin, where it can be removed and disposed of as described above.

It will thus be seen that a mobile battery cleaning system has been described with which the objects of the invention are achieved.

I claim:

1. A mobile battery cleaning system for cleaning batteries on site with clean water which comprises, a wash cabinet to support batteries to be cleaned, a source of clean water under pressure to wash contaminants from said batteries, said wash cabinet having means to collect said washwater from said batteries, sump pump means to pump said washwater from said wash cabinet collection means, a reaction tank connected to said sump pump means to receive said washwater for treatment, agitation means to agitate said wash water in said reaction tank, chemical treatment means to treat said wash water, said chemical treatment means including ph neutralizer means and encapsulation and flocculation chemical means to encapsulate and flocculate said contaminants into floc particles, filter means to separate out said floc particles from said washwater to provide clean water, means to store said floc particles, and means to return said washwater to said clean water source for reuse.

2. A mobile battery cleaning system as defined in claim 1 in which, said chemical treatment means includes dry powdered bentonite clay particles.

3. A mobile battery cleaning system as defined in claim 1 in which, said filter means is a plurality of cloth bag filters.

4. A mobile battery cleaning system as defined in claim 1 in which, said system is transported to said site by truck.

* * * * *